US010399329B2

(12) United States Patent
Tashiro et al.

(10) Patent No.: US 10,399,329 B2
(45) Date of Patent: Sep. 3, 2019

(54) LIQUID DISCHARGING UNIT AND LIQUID DISCHARGING DEVICE

(71) Applicants: Ryo Tashiro, Kanagawa (JP); Kenichiroh Hashimoto, Kanagawa (JP); Takayuki Ito, Kanagawa (JP); Kimito Abe, Kanagawa (JP)

(72) Inventors: Ryo Tashiro, Kanagawa (JP); Kenichiroh Hashimoto, Kanagawa (JP); Takayuki Ito, Kanagawa (JP); Kimito Abe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/176,726

(22) Filed: Oct. 31, 2018

(65) Prior Publication Data

US 2019/0061339 A1 Feb. 28, 2019

Related U.S. Application Data

(63) Continuation of application No. 15/370,601, filed on Dec. 6, 2016, now Pat. No. 10,150,286.

(30) Foreign Application Priority Data

Dec. 8, 2015 (JP) ..... 2015-239407

(51) Int. Cl.
*B41J 2/145* (2006.01)
*B41J 2/01* (2006.01)
*B41J 2/21* (2006.01)

(52) U.S. Cl.
CPC ..... *B41J 2/01* (2013.01); *B41J 2/145* (2013.01); *B41J 2/2117* (2013.01); *B41J 2/21* (2013.01)

(58) Field of Classification Search
CPC ..... B41J 2/01; B41J 2/145; B41J 2/21; B41J 2/2117
See application file for complete search history.

(56) References Cited

U.S. PATENT DOCUMENTS 10,150,286 B2 * 12/2018 Tashiro ..... B41J 2/145 347/43
2005/0237352 A1 10/2005 Yoneyama
(Continued)

FOREIGN PATENT DOCUMENTS

JP 4479224 3/2010
JP 4770734 7/2011
(Continued)

OTHER PUBLICATIONS

U.S. Appl. No. 15/166,988, filed May 27, 2016.

*Primary Examiner* — Yaovi M Ameh
(74) *Attorney, Agent, or Firm* — Oblon, McClelland, Maier & Neustadt, L.L.P.

(57) ABSTRACT

A liquid discharging unit includes a first color nozzle group that includes nozzle arrays each in which nozzle holes for discharging liquids of process colors are arranged in a sub scanning direction perpendicular to a main scanning direction; a second color nozzle group that is provided on upstream side in the sub scanning direction with respect to the first color nozzle group and includes nozzle arrays each in which nozzle holes for discharging liquids of process colors are arranged in the sub scanning direction; and at least one auxiliary nozzle group that is provided between the first color nozzle group and the second color nozzle group and includes nozzle arrays each in which holes for discharging liquids of colors different from the process colors are arranged in the sub scanning direction. The nozzle groups are respectively arranged to be shifted from each other in the main scanning direction.

10 Claims, 9 Drawing Sheets

(56) References Cited

U.S. PATENT DOCUMENTS

| | | | | |
|---|---|---|---|---|
| 2006/0158473 | A1 | 7/2006 | Mills | |
| 2009/0179934 | A1 | 7/2009 | Takagi et al. | |
| 2009/0244137 | A1* | 10/2009 | Kakutani | B41J 2/14201 347/12 |
| 2009/0322814 | A1 | 12/2009 | Sano | |
| 2011/0102489 | A1 | 5/2011 | Sakakibara et al. | |
| 2011/0221805 | A1* | 9/2011 | Yoshida | B41J 2/2107 347/9 |
| 2011/0242200 | A1 | 10/2011 | Tojo | |
| 2012/0062643 | A1 | 3/2012 | Ito | |
| 2012/0236054 | A1 | 9/2012 | Ito et al. | |
| 2012/0249646 | A1 | 10/2012 | Tsuboi | |
| 2013/0194333 | A1 | 8/2013 | Ito et al. | |
| 2014/0347415 | A1 | 11/2014 | Ito et al. | |
| 2016/0361919 | A1* | 12/2016 | Hashimoto | B41J 2/04581 |

FOREIGN PATENT DOCUMENTS

| | | |
|---|---|---|
| JP | 5119867 | 11/2012 |
| JP | 2015-093467 | 5/2015 |

* cited by examiner

LIQUID DISCHARGING UNIT AND LIQUID DISCHARGING DEVICE

CROSS-REFERENCE TO RELATED APPLICATIONS

The present application is a continuation of and based upon U.S. Ser. No. 15/370,601, filed on Dec. 6, 2016, which claims priority under 35 U.S.C. § 119 to Japanese Patent Application No. 2015-239407 filed Dec. 8, 2015. The entire contents of each of the above applications are hereby incorporated herein by reference in entirety.

BACKGROUND OF THE INVENTION

1. Field of the Invention

The present invention relates to a liquid discharging unit and a liquid discharging device.

2. Description of the Related Art

Conventionally, an inkjet type liquid discharging device is used in a sign graphics field such as indoor and outdoor advertisements, the inkjet type liquid discharging device being provided with inks for background such as a white ink and a metallic ink and inks for image formation of process colors such as black (K), yellow (Y), magenta (M), and cyan (C). The liquid discharging device is capable of first applying an ink for a background such as a white ink over a transparent recording medium surface to obtain a solid print and then printing an image with inks for image formation on the solid print.

Japanese Patent No. 4479224 discloses a technology that includes nozzle groups that discharge an ink for a background on both sides such as an upstream side and a downstream side in a medium conveying direction of nozzle groups that discharge process colors. This arrangement enables execution of white anterior printing in which the background is formed with a white ink prior to an image formed with color inks and of white posterior printing in which an image is formed with color inks prior to the background formed with a white ink, and the like.

However, according to the technology disclosed in Japanese Patent No. 4479224, there is a problem that high density of nozzles causes color bleeding along color boundaries between process colors.

In view of the above conventional problems, there is a need to provide a liquid discharging unit and a liquid discharging device capable of obtaining a simple device in which bleeding along color boundaries is hard to occur and capable of performing white anterior printing, intermediate printing, and white posterior printing.

SUMMARY OF THE INVENTION

According to exemplary embodiments of the present invention, there is provided

Exemplary embodiments of the present invention also provide

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
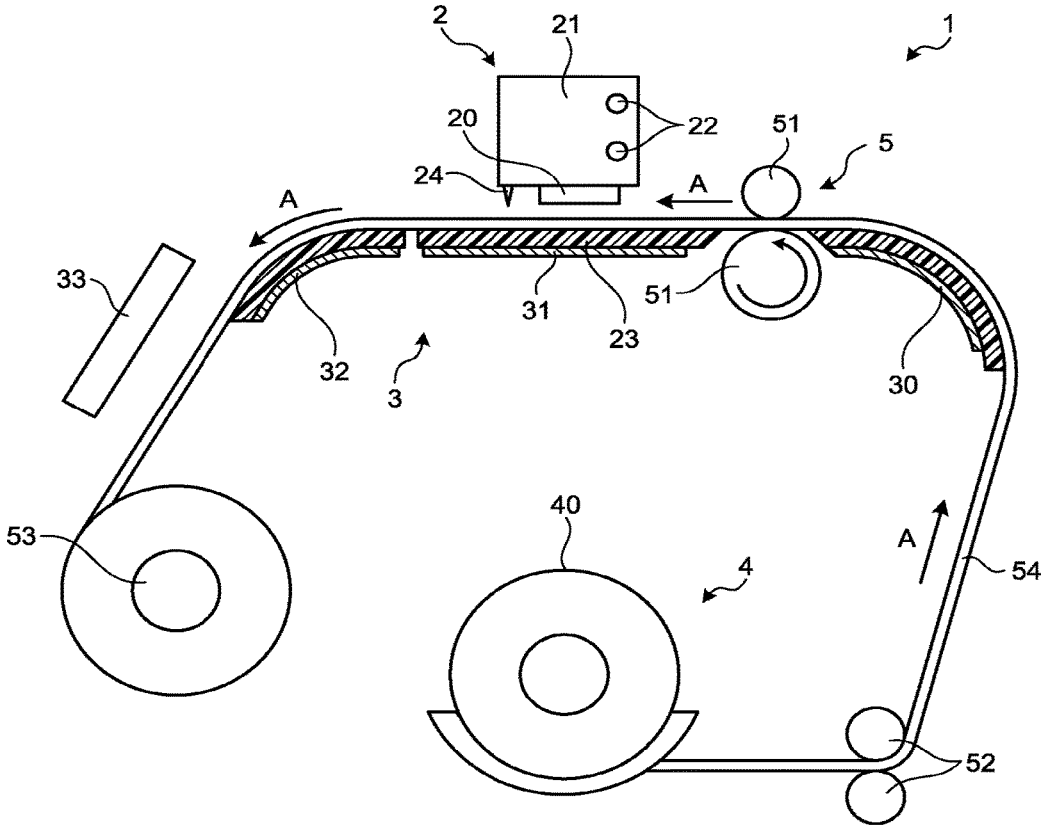
FIG. 1 is a schematic diagram illustrating a configuration of an inkjet recording device according to a first embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Exemplary embodiments of a liquid discharging unit and a liquid discharging device will be explained in detail below with reference to the accompanying drawings. The embodiments will explain examples in which a recording head is applied as the liquid discharging unit and an inkjet recording device is applied as the liquid discharging device.

First Embodiment

FIG. 1 is a schematic diagram illustrating a configuration of an inkjet recording device 1 according to a first embodiment. The inkjet recording device 1 which is the liquid discharging device is a serial type inkjet recording device. As illustrated in FIG. 1, the inkjet recording device 1 includes an image forming unit 2 that prints a required image, a drying device 3, a roll media storage unit 4, and a conveying mechanism 5. The roll media storage unit 4 stores roll media (recording media (medium)) 40. The roll media storage unit 4 can store recording media 40 with different sizes in the width direction. The recording medium 40 is for example a transparent non-permeable medium such as polyethylene terephthalate (PET) film.

The conveying mechanism 5 constitutes a conveying unit of a roll-to-roll method. The conveying mechanism 5 has a pair of nip rollers 51, a pair of driven rollers 52, and a winding roller 53, which are provided on a conveying path 54 of the recording medium 40. The nip rollers 51 are provided in front of the image forming unit 2 (on the upstream side in a conveying direction A). The nip rollers 51 convey the recording medium 40 sandwiched thereby by being rotated with the driving of a motor M (see FIG. 2) toward the image forming unit 2. The winding roller 53 is rotated with the driving of the motor M to wind up the printed recording medium 40. The driven rollers 52 are rotated with the conveyance of the recording medium 40.

The conveying mechanism 5 includes a wheel encoder 55 (see FIG. 2) for detecting a conveying speed. The conveying speed of the conveying mechanism 5 is controlled by the control of the motor M based on a target value and a speed detected value obtained by sampling detection pulses sent from the wheel encoder 55.

In other words, the recording medium 40 stored in the roll media storage unit 4 is conveyed to the image forming unit 2 via the driven rollers 52 through the rotation of the nip rollers 51. The recording medium 40 having reached the image forming unit 2 is printed with a required image by the image forming unit 2. The recording medium 40 after being printed is then wound up through the rotation of the winding roller 53.

The image forming unit 2 includes a carriage 21. The carriage 21 is slidably held by guide rods (guide rails) 22. The carriage 21 moves along the guide rods (guide rails) 22 with the driving of the motor M in a direction (main scanning direction) perpendicular to the conveying direction A of the recording medium 40. More specifically, the carriage 21 reciprocates within a recording area where the image forming unit 2 can print an image, in a main scanning area which is a movable area in the main scanning direction, with respect to the recording medium 40 conveyed by the conveying mechanism 5.

The carriage 21 includes a recording head 20 in which a plurality of nozzle holes each being a discharge opening for discharging a liquid droplet are arranged. The recording head 20 is integrally provided with a tank for supplying ink to the recording head 20. However, the recording head 20 is not limited to those that are integrally provided with a tank, but may be separately provided with a tank. The recording head 20 functions as a liquid discharging unit and discharges color ink droplets of black (k), yellow (Y), magenta (M), and cyan (C) which are recording liquids of process colors. The black (k), yellow (Y), magenta (M), and cyan (C) are inks for image formation. In addition, the recording head 20 discharges an ink droplet of white (W) which is an ink for a background. Moreover, the recording head 20 discharges color inks of orange (O) and green (G) which are special color recording liquids with a difference in hue from the recording liquids of these process colors, which are used to improve color reproducibility.

The image forming unit 2 includes a platen 23 for supporting the recording medium 40 below the recording head 20 at the time of printing using the recording head 20.

The image forming unit 2 also includes an encoder sheet for detecting a main scanning position of the carriage 21 along the main scanning direction of the carriage 21. The carriage 21 includes an encoder 26 (see FIG. 2). The image forming unit 2 is configured so that the encoder 26 of the carriage 21 reads the encoder sheet to detect the main scanning position of the carriage 21.

The carriage 21 includes a sensor 24 that optically detects an edge of the recording medium 40 according to the movement of the carriage 21. The detection signal detected by the sensor 24 is used to calculate a position of the edge of the recording medium 40 in the main scanning direction and a width of the recording medium 40.

The drying device 3 includes a preheater 30, a platen heater 31, a drying heater 32, and a warm air fan 33. The preheater 30, the platen heater 31, and the drying heater 32 are electric heaters using, for example, ceramic or nichrome wire.

The preheater 30 is provided on the upstream in the conveying direction A of the recording medium 40 with respect to the image forming unit 2. The preheater 30 preliminarily heats the recording medium 40 conveyed by the conveying mechanism 5.

The platen heater 31 is disposed on the platen 23. The platen heater 31 heats the recording medium 40 on which ink droplets discharged from the nozzle holes of the recording head 20 are caused to land.

The drying heater 32 is provided on the downstream in the conveying direction A of the recording medium 40 with respect to the image forming unit 2. The drying heater 32 continuously heats the recording medium 40 printed by the image forming unit 2 to facilitate the drying of the ink droplets that land on the recording medium 40.

The warm air fan 33 is provided on the downstream in the conveying direction A of the recording medium 40 with respect to the drying heater 32 (image forming unit 2). The warm air fan 33 blows the warm air to the recording surface of the recording medium 40 on which the ink droplets land. The warm air fan 33 directly blows the warm air to the ink on the recording surface of the recording medium 40 to thereby decrease the atmospheric humidity around the recording surface of the recording medium 40, and dries the ink completely.

By installing the drying device 3, the inkjet recording device 1 can adopt any non-permeable medium as the recording medium 40, such as vinyl chloride, PET, and acryl, which the ink does not permeate. When the non-permeable medium is adopted, the inkjet recording device 1 can adopt, as inks used for image forming unit 2, solvent-based inks excellent in fixing also to the non-permeable medium or water-soluble resin inks containing much resin component.

The inkjet recording device 1, configured so that the inks are discharged from the recording head 20 while the carriage 21 reciprocates within the width of the recording medium 40 to form an image, includes unidirectional printing for discharging inks only when a carriage operation is performed only on a forward path to form an image, and bidirectional printing for discharging inks when the carriage operation is performed on both forward and return paths to form an image. The bidirectional printing that is advantageous at a point of a printing speed is mainly used in the inkjet recording device 1. Herein, an operation of discharging inks from the recording head 20 while the carriage 21 is moving in the main scanning direction is determined as one scan.

Figure 2:
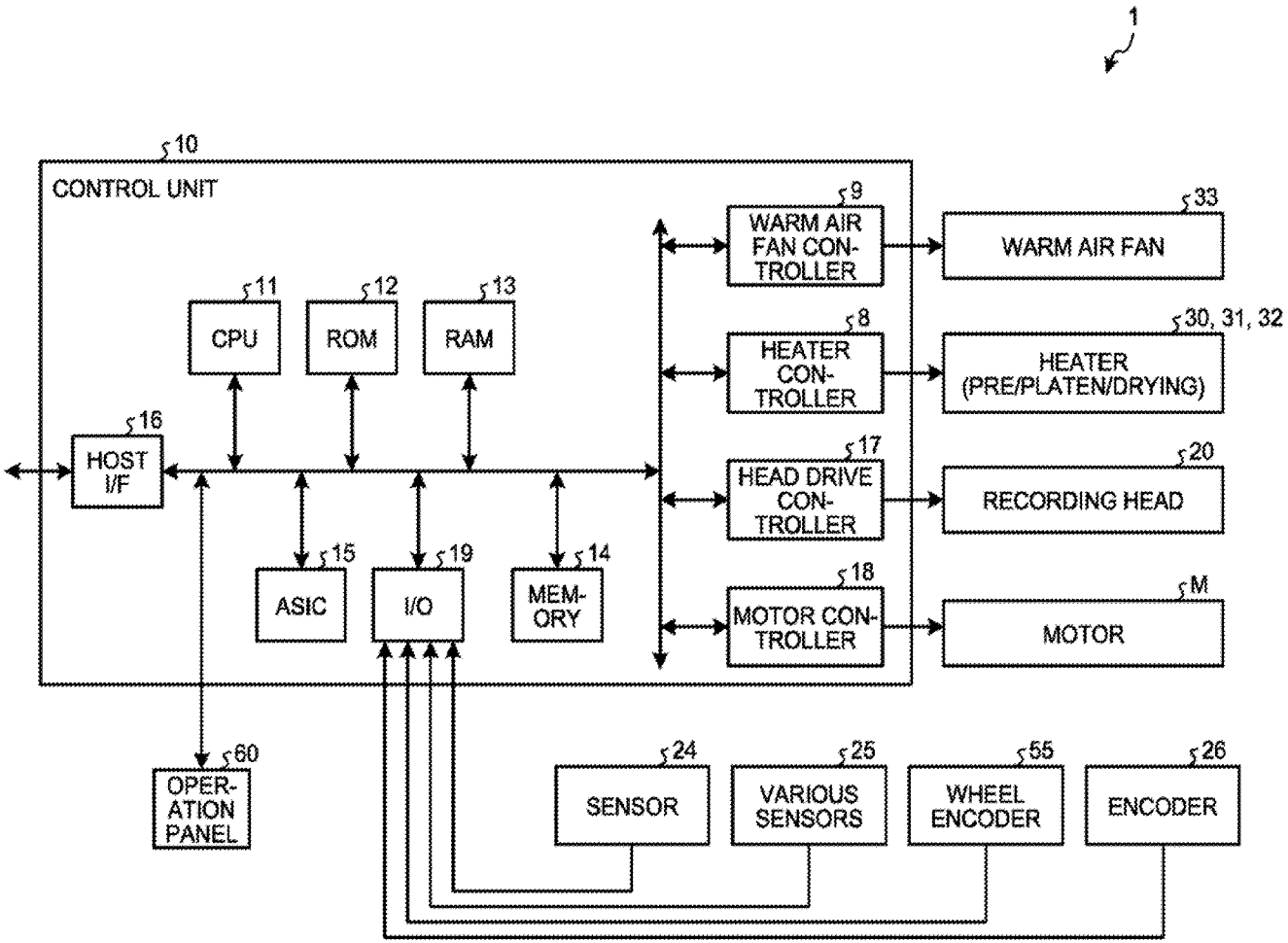
FIG. 2 is a block diagram illustrating a control configuration of the inkjet recording device.

A control configuration of the inkjet recording device 1 will be explained next. FIG. 2 is a block diagram illustrating the control configuration of the inkjet recording device 1.

As illustrated in FIG. 2, the inkjet recording device 1 includes a control unit 10 that controls the entire device. The control unit 10 includes a central processing unit (CPU) 11 as a main control unit, a read-only memory (ROM) 12, a random access memory (RAM) 13, a memory 14, and an application specific integrated circuit (ASIC) 15. The ROM 12 stores computer programs executed by the CPU 11 and other fixed data. The RAM 13 temporally stores image data and the like. The memory 14 is a rewritable nonvolatile memory for storing data even when a power supply of the inkjet recording device 1 is cut off. The ASIC 15 executes image processing such as various types of signal processing and sorting on image data, and also executes input-output signal processing for controlling the entire device.

As illustrated in FIG. 2, the control unit 10 includes a host interface (I/F) 16, a head drive controller 17, a motor controller 18, and an input/output (I/O) 19.

The host I/F 16 performs transmission/reception of image data (print data) and a control signal with a host side via a cable or via a network. Examples of the host connected to the inkjet recording device 1 include, but are not limited to, an information processing device such as a personal computer, an image reading device such as an image scanner, and an imaging device such as a digital camera.

The I/O 19 receives a detection pulse from the encoder 26 and the wheel encoder 55. In addition, the I/O 19 connects various sensors 25 such as a humidity sensor, a temperature sensor, and other sensors to the control unit 10, in addition to the sensor 24. The I/O 19 receives a detection signal from the sensor 24 and the various sensors 25.

The head drive controller 17 controls the drive of the recording head 20, and includes a data transfer unit. More specifically, the head drive controller 17 transfers image data as serial data. The head drive controller 17 generates a transfer clock and a latch signal, which are required for transfer of image data and confirmation of the transfer or the like, and also generates a drive waveform used when a liquid droplet is discharged from the recording head 20. The head drive controller 17 inputs the generated drive waveform etc. to a drive circuit inside the recording head 20.

The motor controller 18 drives the motor M. More specifically, the motor controller 18 calculates a control value based on a target value given from the CPU 11 and a speed detected value obtained by sampling detection pulses sent from the wheel encoder 55. The motor controller 18 drives the motor M based on the calculated control value via an internal motor drive circuit.

The control unit 10 also includes a heater controller 8 and a warm air fan controller 9.

The heater controller 8 controls the outputs so that temperatures of the preheater 30, the platen heater 31, and the drying heater 32 become set temperatures respectively. More specifically, when controlling the heaters 30, 31, and 32, the heater controller 8 acquires temperature information using temperature sensors respectively provided in the heaters 30, 31, and 32. The heater controller 8 then controls so that the temperatures of the heaters 30, 31, and 32 become set temperatures respectively while monitoring the temperatures of the heaters 30, 31, and 32. When heaters are provided on the tank and ink routes of the recording head 20, the heater controller 8 also controls the heaters in the above manner.

The warm air fan controller 9 controls the output of the warm air fan 33 so that ventilation is performed at a predetermined temperature and air volume.

In addition, the control unit 10 is connected with an operation panel 60 for performing an input and a display of information required for the inkjet recording device 1.

The control unit 10 integrally controls the units by the CPU 11 that loads the computer program read from the ROM 12 (or memory 14) into the RAM 13 and executes the loaded program. More specifically, the CPU 11 reads the control contents set in each print mode from the ROM 12 (or the memory 14) based on the print mode set through the operation panel 60. The CPU 11 then controls the units based on the control contents read from the ROM 12 (or the memory 14).

The computer program executed by the inkjet recording device 1 according to the present embodiment is provided by being recorded in a computer-readable recording medium such as a compact disk read only memory (CD-ROM), a flexible disk (FD), a compact disk recordable (CD-R), and a digital versatile disk (DVD) in an installable or executable file format.

The computer program executed by the inkjet recording device 1 according to the present embodiment may be configured to be provided by being stored on a computer connected to a network such as the Internet and being downloaded via the network. The computer program executed by the inkjet recording device 1 according to the present embodiment may also be configured to be provided or distributed via a network such as the Internet.

The computer program executed by the inkjet recording device 1 according to the present embodiment may be configured to be provided by being preinstalled in a ROM or the like.

Image data transfer/printing processing executed by the control unit 10 of the inkjet recording device 1 will be briefly explained next. The CPU 11 of the control unit 10 reads and analyses image data (print data) in a reception buffer included in the host I/F 16 and performs image processing and sorting processing of data required for the ASIC 15. Subsequently, the CPU 11 of the control unit 10 transfers the image data (print data) processed at the ASIC 15 from the head drive control unit 17 to the recording head 20.

It may be configured so that dot pattern data for image output is generated by storing font data in, for example, the ROM 12 or the image data is converted into bitmap data by a host-side printer driver to be transferred to the inkjet recording device 1.

Characteristic functions of the inkjet recording device 1 will be explained next. The inkjet recording device 1 according to the present embodiment has the following features upon inkjet printing to the recording medium 40 which is a transparent non-permeable medium.

Essentially, the inkjet recording device 1 is configured to increase the drying rate of inks by reducing the ink adhesion amount per unit area in one scan. Thus, when color inks are applied to the white ink, the inkjet recording device 1 can suppress color buried or color mixture, suppress bleeding along a boundary between different colors, and prevent a coating area from being reduced due to its contraction in response to a contact of adjacent droplets with each other between the same colors.

Figure 3:
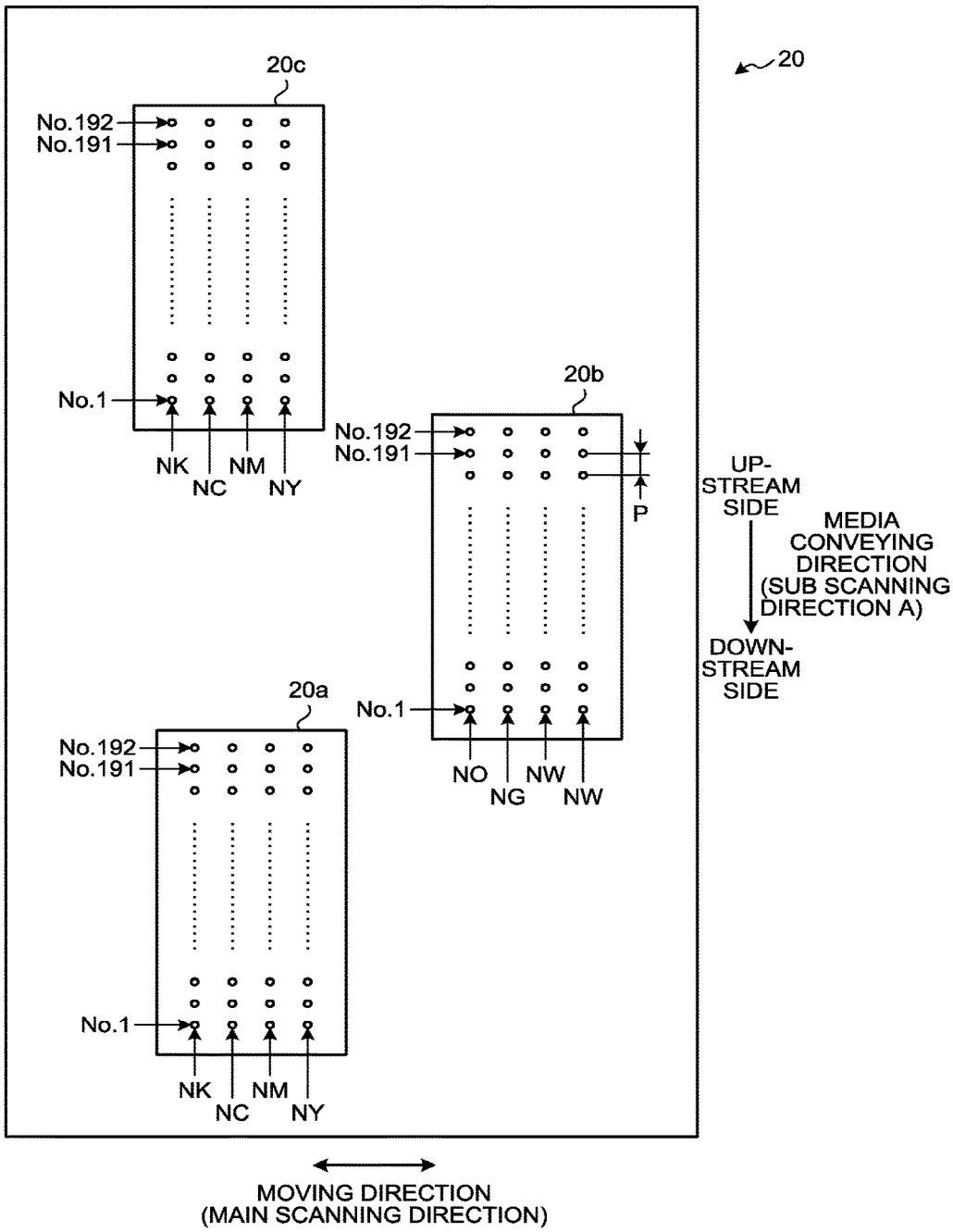
FIG. 3 is a plan view illustrating a nozzle configuration of a recording head.
Figure 4:
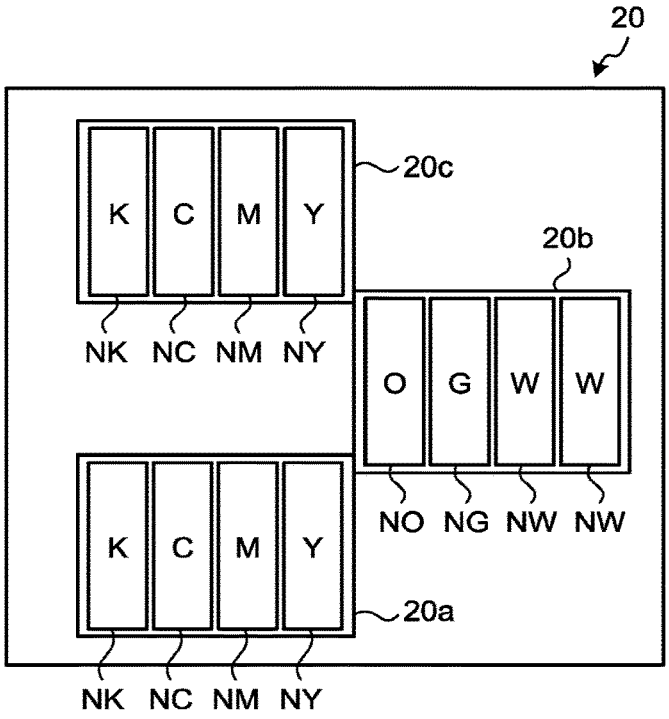
FIG. 4 is a schematic diagram schematically illustrating colors of nozzle arrays.

FIG. 3 is a plan view illustrating a nozzle configuration of the recording head 20, and FIG. 4 is a schematic diagram schematically illustrating colors of nozzle arrays. FIG. 3 transparently represents the nozzle arrays of the recording head 20 from above. As illustrated in FIG. 3, the recording head 20 includes a first nozzle group 20*a* being a first color nozzle group, a second nozzle group 20*b* being an auxiliary nozzle group, and a third nozzle group 20*c* being a second color nozzle group.

As illustrated in FIG. 3, the nozzle groups 20*a*, 20*b*, and 20*c* are arranged in two lines in the main scanning direction and are alternately arranged in zigzag in the sub-scanning direction. In other words, the nozzle groups 20*a*, 20*b*, and 20*c* are arranged in order from the third nozzle group 20*c*, the second nozzle group 20*b*, and the first nozzle group 20*a* so that the nozzle arrays do not overlap each other from the upstream side to the downstream side in the conveying direction A of the recording medium 40. In addition, as illustrated in FIG. 3, the second nozzle group 20*b* is disposed by shifting its position from the first nozzle group 20*a* and the third nozzle group 20*c* in the main scanning direction.

Each of the first nozzle group 20*a* and the third nozzle group 20*c* includes four nozzle arrays that discharge ink droplets of KCMY (process colors) for image formation. Each of the nozzle arrays has 192 nozzle holes from a nozzle hole of nozzle number (No.) 1 to a nozzle hole of nozzle number (No.) 192. In the example illustrated in FIG. 3, for nozzle holes, the nozzle numbers are set in such a manner that the nozzle No. 1 to the nozzle No. 192 are assigned to those from the nozzle hole in the downstream side to the nozzle hole in the upstream side in the conveying direction A of the recording medium 40. Each pitch P between the nozzle holes is 150 dots per inch (dpi).

As illustrated in FIG. 4, each of the first nozzle group 20*a* and the third nozzle group 20*c* has a yellow-ink nozzle array NY that discharges an ink droplet of yellow (Y), a magenta-ink nozzle array NM that discharges an ink droplet of magenta (M), a cyan-ink nozzle array NC that discharges an ink droplet of cyan (C), and a nozzle array that discharges an ink droplet of black (k).

Similarly to the first nozzle group 20*a*, the second nozzle group 20*b* also includes four nozzle arrays each having 192 nozzle holes from nozzle No. 1 to nozzle No. 192. In the second nozzle group 20*b* similar to the first nozzle group 20*a*, the pitch P between the nozzle holes is 150 dpi.

The second nozzle group 20*b* includes nozzle arrays for auxiliary recording. Specifically, the second nozzle group 20*b* includes two nozzle arrays that discharge ink droplets of color for background formation and two nozzle arrays that discharge ink droplets of special colors for image formation.

As illustrated in FIG. 4, the second nozzle group 20*b* includes two nozzle arrays NW that discharge ink droplets of white (W) as an example of an ink for background formation. Moreover, the second nozzle group 20*b* includes a nozzle array NO that discharges ink droplets of orange (O) and a nozzle array NG that discharges ink droplets of green (G) as an example of special color inks for image formation.

The reason that the nozzle array NW that discharges ink droplets of white (W) is set to two arrays is because the amount of discharge is increased because the white color is frequently used for background formation to cover the whole area.

Thus, the first nozzle group 20*a* and the third nozzle group 20*c* that discharge ink droplets for image formation and the second nozzle group 20*b* that discharges ink droplets of the colors for auxiliary recording are arranged in two lines in the main scanning direction, and the second nozzle group 20*b* is disposed in zigzag with respect to the other nozzle groups. Thereby, a plurality of nozzle groups that discharge ink droplets for image formation are provided, and this enables the inkjet recording device 1 to reduce the ink adhesion amounts of the KCMY (process colors) for image formation per each unit area in one scan and to increase the drying rate of the inks of the KCMY (process colors) for image formation. In other words, by speeding up the drying of the inks of the KCMY (process colors) for image formation, it is possible to suppress bleeding along a boundary between different colors, and to prevent the coating area from being reduced due to its contraction in response to the contact of adjacent droplets with each other between the same colors.

By setting the two arrays in the second nozzle group 20*b* to the nozzle arrays NW that discharge ink droplets of white (W), the inkjet recording device 1 can reduce an application amount of the white ink in one scan as much as possible, so that the white ink as the background color can be dried until the KCMY (process colors) inks are applied and the color buried and color mixture at the time of applying the KCMY (process colors) inks onto the white ink can be suppressed. If the total application amount is tried to be equal, the number of scans becomes a larger number, but by connecting the nozzle groups to each other in the sub scanning direction instead of the main scanning direction, high quality printing can be achieved without degreasing the productivity.

In the inkjet recording device 1, when the recording head 20 has the nozzle configuration and if the KCMY (process colors) and the white ink are used, the improvement of the productivity can be estimated in all the processes such as the anterior printing, the posterior printing, and the intermediate printing of the white ink.

When the recording head 20 has the nozzle configuration and if the KCMY (process colors), the special colors, and the white ink are used, the inkjet recording device 1 evenly uses the nozzle arrays that discharge special color ink droplets and the nozzle arrays that discharge white ink droplets in the second nozzle group 20*b*, thus enabling all the processes such as the anterior printing, the posterior printing, and the intermediate printing of the white ink for the six colors.

The inkjet recording device 1 can obtain comparatively low nozzle density by arranging the nozzle groups 20*a*, 20*b*, and 20*c* so as to be prolonged in the sub scanning direction even when the white ink is not used. In other words, the ink adhesion amount per unit area in one scan can be reduced, and dots of adjacent droplets are thereby hard to contact each other and bleeding along the color boundary can be suppressed, thus significantly improving the productivity.

Consequently, according to the inkjet recording device 1 of the first embodiment, it is possible to obtain a simple device in which bleeding along the color boundary is hard to occur and the white anterior printing, the intermediate printing, and the white posterior printing are possible.

In the present embodiment, orange and green are applied as special colors. However, the embodiments are not limited thereto, and therefore special colors of red and blue etc. may be used, or light inks such as light cyan, light magenta, and gray may be used as special colors.

In the present embodiment, the white ink is applied as an auxiliary ink, however, the embodiments are not limited thereto. The inkjet recording device 1 can apply a silver ink, a gold ink, a transparent ink, a primer, a surface protective agent, etc., as an auxiliary ink. The auxiliary ink is used basically to improve the quality of an image and add some texture thereto by forming an auxiliary layer on the surface or the back of an image layer which is a layer of an image formed with the inks for image formation.

Moreover, in the present embodiment, the black ink is also included in the process colors for image formation, however, it may also be configured not to include the black ink in the process colors for image formation.

Second Embodiment

A second embodiment will be explained next. However, the same reference signs are assigned to the same components as these of the first embodiment, and explanation thereof is therefore omitted.

The second embodiment is different from the first embodiment in an arrangement among the first nozzle group 20*a*, the second nozzle group 20*b*, and the third nozzle group 20*c* in the recording head 20.

Figure 5:
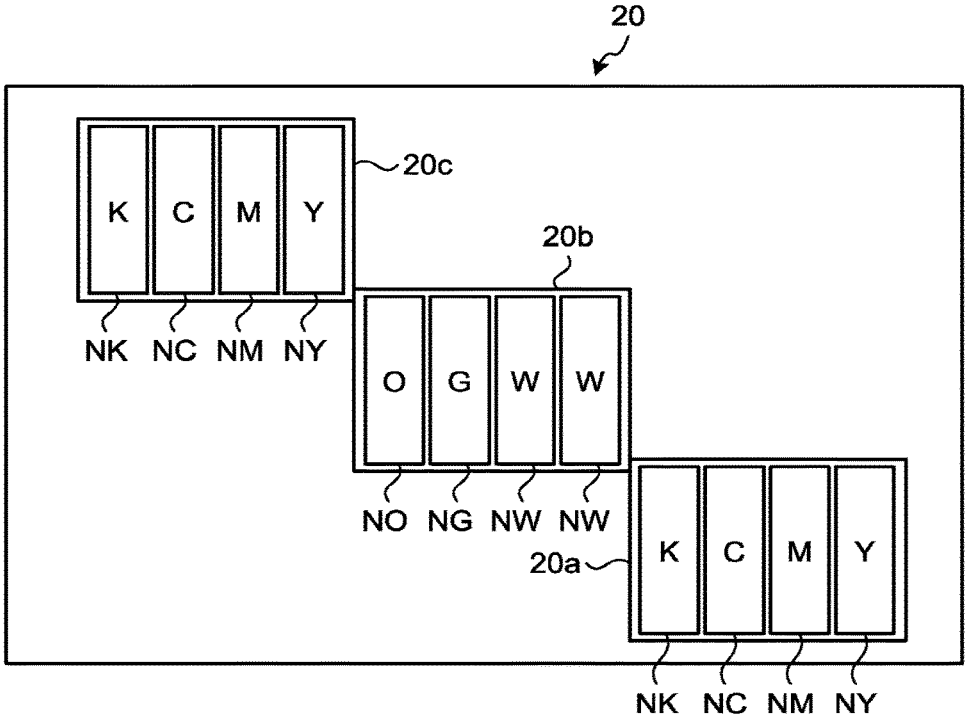
FIG. 5 is a schematic diagram schematically illustrating colors of nozzle arrays according to a second embodiment of the present invention.

FIG. 5 is a schematic diagram schematically illustrating colors of nozzle arrays according to the second embodiment. As illustrated in FIG. 5, the nozzle groups 20*a*, 20*b*, and 20*c* are arranged in three lines in the main scanning direction by being shifted from each other in the sub scanning direction.

Even when the nozzle configuration in the recording head 20 is as illustrated in FIG. 5, the inkjet recording device 1 can suppress color buried or color mixture at the time of applying color inks onto the white ink, suppress bleeding along a boundary between different colors, and prevent the coating area from being reduced due to its contraction in response to a contact of adjacent droplets with each other between the same colors.

Figure 6:
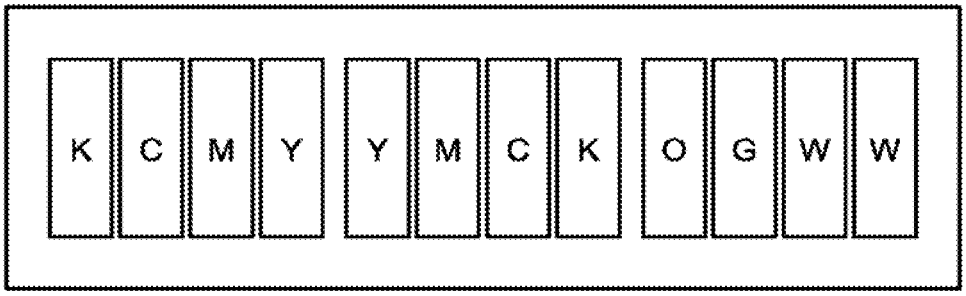
FIG. 6 is a schematic diagram schematically illustrating colors of nozzle arrays in a conventional recording head.

A comparison result between the inkjet recording device 1 provided with the recording head 20 having the nozzle configuration illustrated in FIG. 5 and an inkjet recording device with a conventional nozzle configuration will be explained below. FIG. 6 is a schematic diagram schematically illustrating colors of nozzle arrays in the conventional recording head. As illustrated in FIG. 6, the conventional recording head is configured so that 12 nozzle arrays of the recording head 20 are divided by the KCMY (process colors) for image formation, the special colors (O, G), and the white color (W×2).

Figure 7:
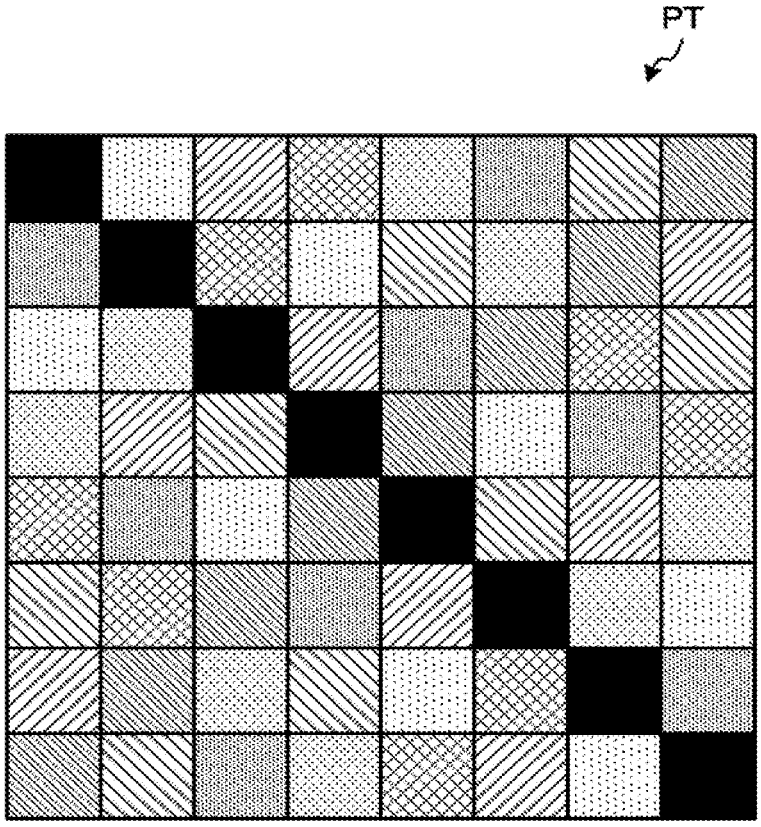
FIG. 7 is a diagram illustrating one example of a bleeding check pattern.

Upon comparison, when the nozzle density of one nozzle array is 150 dpi and the resolution of a finished image is 900 dpi×900 dpi, a mode that performs 6 scans per nozzle array width is used to print a bleeding check pattern PT illustrated in FIG. 7.

For comparison, it is assumed that "time to wait for drying" such that the carriage 21 is stopped at a scan edge is provided and the time is converted to the productivity ($m^2$/h).

Figure 8:
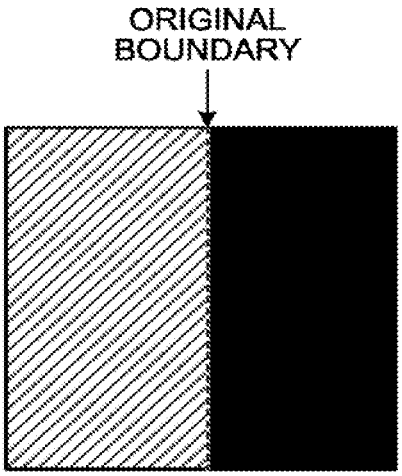
FIG. 8 is a diagram illustrating one example of a printed result.

When the productivity is 40 $m^2$/h, in the printing using the recording head 20 with the nozzle configuration illustrated in FIG. 5, a satisfactory result with no bleeding (blurring) as illustrated in FIG. 8 along all the boundaries between squares can be obtained.

Figure 9:
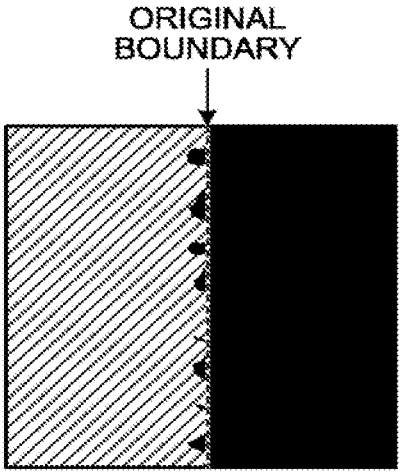
FIG. 9 is a diagram illustrating one example of a conventional printed result.

On the other hand, in the printing using the conventional recording head illustrated in FIG. 6, image quality defects such as bleeding (blurring) as illustrated in FIG. 9 occur.

The productivity is 20 $m^2$/h when the satisfactory result as illustrated in FIG. 8 is obtained by using the conventional recording head illustrated in FIG. 6.

As a result, when the recording head 20 with the nozzle configuration illustrated in FIG. 5 is used, it is understood that the productivity can be twice as much as the case of using the conventional recording head illustrated in FIG. 6.

As for the recording head 20 with the nozzle configuration illustrated in FIG. 5, in the first nozzle group 20*a* and the third nozzle group 20*c* for image formation, the order of arranging is K, C, M, and Y, and in the second nozzle group 20*b* for special colors, the order of arranging is O and G. However, it is desirable that these colors are arranged in the order from the color that comes out good in coloring.

In a permeable paper, the color of an ink that first lands on the paper becomes dominant in coloring, while in the recording medium 40 which is a transparent non-permeable medium such as a PET film, the color of an ink that lands on the paper later comes out more easily than previous ones when viewed from the surface side. Therefore, for example, when the color of orange (O) is desirably emphasized than black (K) and if the white anterior printing is to be performed on the recording medium 40, it is preferable that orange (O) of the second nozzle group 20*b* for special colors is changed to black (k) and black (k) of the third nozzle group 20*c* is changed to orange (O) in the configuration of FIG. 5.

Conversely, in the case of white posterior printing, printing is viewed from its reverse surface, and therefore the color of an ink that first lands on the paper becomes strong in coloring. Therefore, it is preferable that black (k) of the first nozzle group 20*a* for image formation is changed to orange (O) and orange (O) of the second nozzle group 20*b* for special colors is changed to black (k).

In the intermediate printing of the white color, also, by changing black (k) of the first nozzle group 20*a* for image formation to orange (O) and by changing orange (O) of the second nozzle group 20*b* for special colors to black (k), the color of orange (O) can be enhanced in coloring.

The above has described the nozzle configuration in the case of emphasizing coloring of orange. However, when the entire color gamut is to be enlarged, a single color cannot be emphasized, and therefore it is desirable to compare these cases in various conditions. Especially, in the same nozzle group of the nozzle groups 20*a*, 20*b*, and 20*c*, adjacent droplets contact each other before being dried to cause the colors to mix each other regardless of user's intention, and therefore it is preferable to actually print the image to check how it is like. Thereafter, a nozzle arrangement is preferably selected so that the color gamut becomes largest. The arrangement order of the nozzle arrays in the nozzle groups 20*a*, 20*b*, and 20*c* is preferable that the color gamut of an image to be formed becomes the largest.

Thus, according to the inkjet recording device 1 of the second embodiment, it is possible to obtain a simple device in which bleeding along the color boundary is hard to occur and the white anterior printing, the intermediate printing, and the white posterior printing are possible.

In the first embodiment and the second embodiment, the configuration, in which the three nozzle groups: the first nozzle group 20*a* for image formation, the second nozzle group 20*b* for auxiliary recording, and the third nozzle group 20*c* for image formation are arranged, has been explained as the recording head 20, however, the embodiments are not limited thereto.

Figure 10:
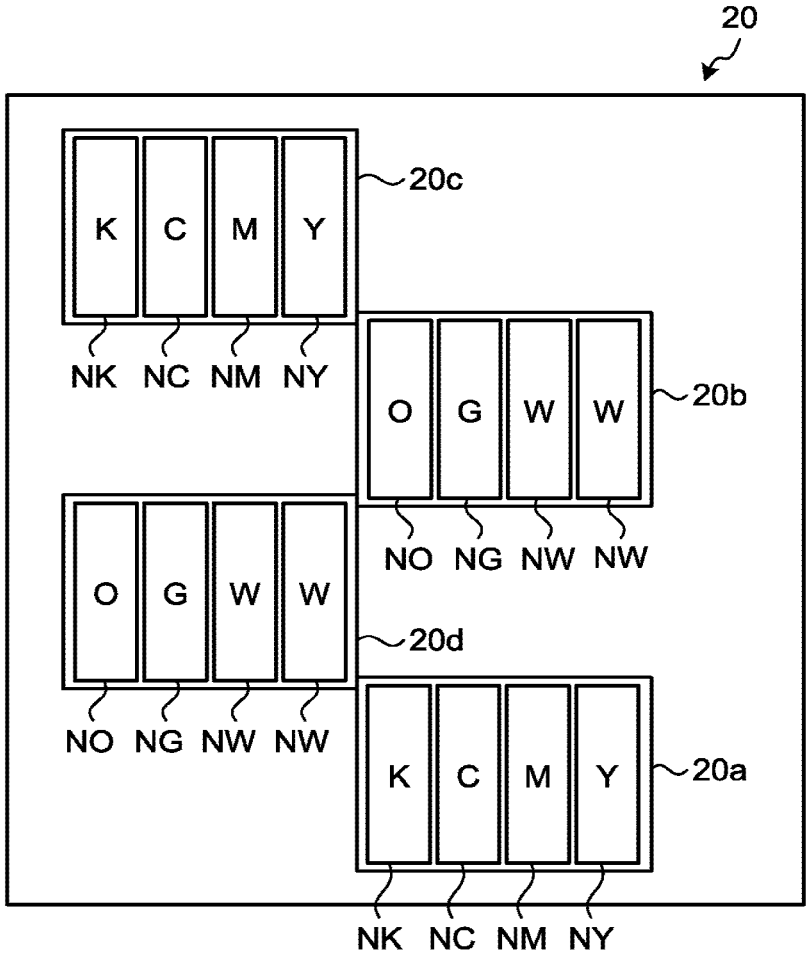
FIG. 10 is a schematic diagram illustrating a modification of the nozzle configuration and the colors of nozzle arrays in the recording head.
Figure 11:
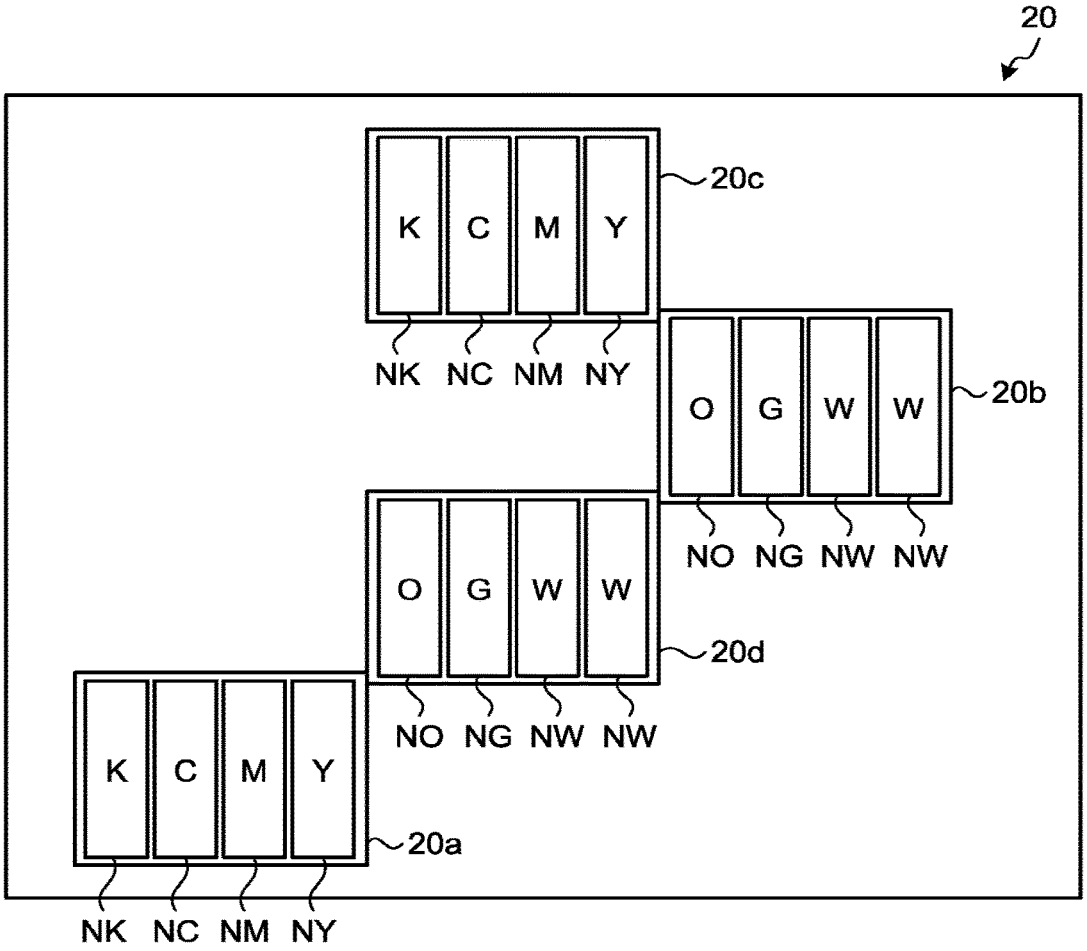
FIG. 11 is a schematic diagram illustrating a modification of the nozzle configuration and the colors of nozzle arrays in the recording head.
Figure 12:
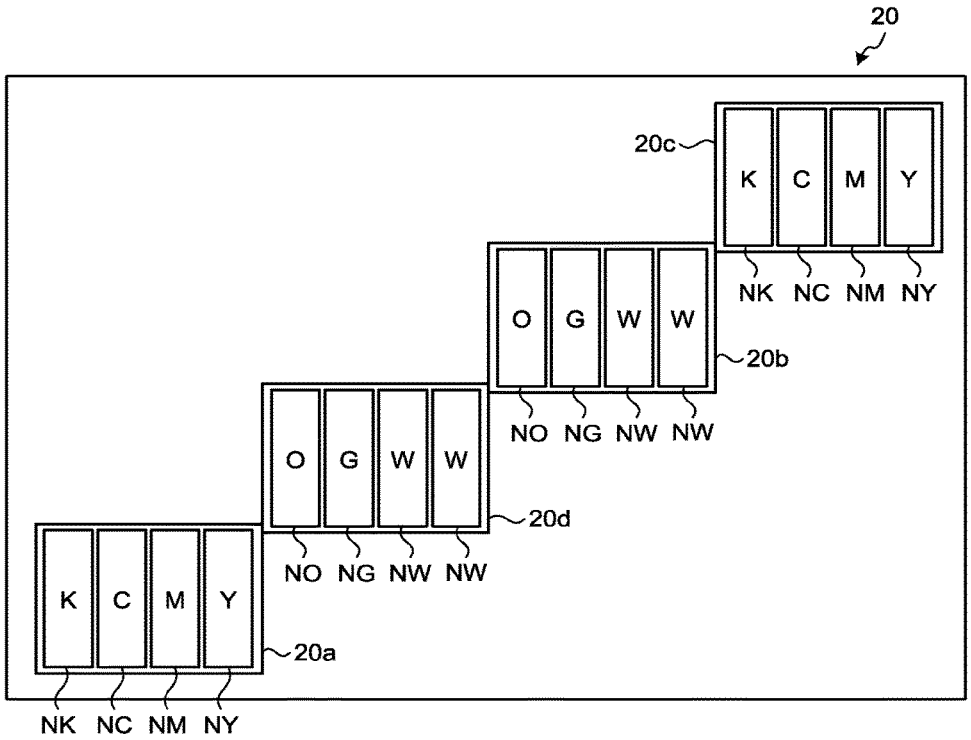
FIG. 12 is a schematic diagram illustrating a modification of the nozzle configuration and the colors of nozzle arrays in the recording head.

For example, the recording head 20 may be those, as illustrated in FIGS. 10 to 12, in which a fourth nozzle group 20*d* being an auxiliary nozzle group is disposed in addition to the first nozzle group 20*a* for image formation, the second nozzle group 20*b* for auxiliary recording, and the third nozzle group 20*c* for image formation.

According to the examples illustrated in FIGS. 10 to 12, the nozzle groups are arranged in order of the third nozzle group 20*c*, the second nozzle group 20*b*, the fourth nozzle group 20*d*, and the first nozzle group 20*a* so that the nozzle arrays do not overlap each other from the upstream side to the downstream side in the conveying direction A of the recording medium 40.

According to exemplary embodiments of the present invention, it is possible to obtain a simple device in which bleeding along the color boundary is hard to occur and the white anterior printing, the intermediate printing, and the white posterior printing are possible.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

Further, any of the above-described apparatus, devices or units can be implemented as a hardware apparatus, such as a special-purpose circuit or device, or as a hardware/software combination, such as a processor executing a software program.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharging unit comprising:

a first color nozzle group that includes nozzle arrays each in which a plurality of nozzle holes to discharge liquids of process colors for image formation are arranged in a sub scanning direction perpendicular to a main scanning direction;

a second color nozzle group that is provided on an upstream side in the sub scanning direction with respect to the first color nozzle group, and that includes nozzle arrays each in which a plurality of nozzle holes to discharge liquids of process colors are arranged in the sub scanning direction; and at least one auxiliary nozzle group that is provided between the first color nozzle group and the second color nozzle group, and that includes nozzle arrays each in which a plurality of nozzle holes to discharge liquids of colors different from the process colors are arranged in the sub scanning direction, wherein the first color nozzle group, the at least one auxiliary nozzle group, and the second color nozzle group are respectively shifted from each other in the main scanning direction, the first color nozzle group and the second color nozzle group each include respective nozzle arrays to respectively discharge, as the liquids of process colors, color ink droplets of black, yellow, magenta, and cyan, the at least one auxiliary nozzle group includes nozzle arrays to discharge liquid droplets of special color recording liquids for image formation with a difference in hue from the liquids of process colors, and nozzle arrays to discharge ink droplets of color for background formation, the nozzle arrays to discharge the liquid droplets of special color include special color nozzle arrays to discharge any one of inks of colors of red, green, blue, orange, purple, silver, and gold as the special color, and a number of nozzle arrays of the special color nozzle arrays for each individual special color is less than that of the nozzle arrays to discharge ink droplets of color for background formation.

2. The liquid discharging unit according to claim 1, wherein the at least one auxiliary nozzle group is to discharge a white ink as the ink droplets of color for the background formation.

3. The liquid discharging unit according to claim 1, wherein an arrangement order of the nozzle arrays in the first color nozzle group, the at least one auxiliary nozzle group, and the second color nozzle group is an arrangement order in which a color gamut of an image to be formed becomes largest.

4. The liquid discharging unit according to claim 1, wherein the nozzle arrays to discharge ink droplets of color for background formation is set to two arrays.

5. The liquid discharging unit according to claim 1, wherein the at least one auxiliary nozzle group is set to one group, and the first color nozzle group and the second color nozzle group overlap each other in the main scanning direction.

6. The liquid discharging unit according to claim 1, wherein the nozzle holes of one or more nozzle group among the first color nozzle group, the at least one auxiliary nozzle group, and the second color nozzle group are disposed without overlapping in the main scanning direction with any other nozzle hole in the liquid discharging unit that is not of the one or more nozzle group.

7. The liquid discharging unit according to claim 1, wherein the at least one auxiliary nozzle group is set to one group, and the first color nozzle group and the second color nozzle group do not overlap each other in the main scanning direction and do not overlap each other in the sub scanning direction.

8. The liquid discharging unit according to claim 1, wherein the at least one auxiliary nozzle group is set to two groups, the first color nozzle group and the second color nozzle group do not overlap each other in the main scanning direction, and the two auxiliary nozzle groups do not overlap each other in the main scanning direction.

9. A liquid discharging device comprising:

a media storage to store recording media;

a conveyor to convey the recording media stored in the media storage;

an image former provided with a liquid discharging unit according to claim 1 to form an image by discharging liquid while reciprocating the liquid discharging unit in a main scanning direction with respect to the recording media conveyed by the conveyor; and a dryer to dry the image formed by the image former.

10. A liquid discharging unit comprising:

a first color nozzle group that includes nozzle arrays each in which a plurality of nozzle holes to discharge liquids of process colors for image formation are arranged in a sub scanning direction perpendicular to a main scanning direction;

a second color nozzle group that is provided on an upstream side in the sub scanning direction with respect to the first color nozzle group, and that includes nozzle arrays each in which a plurality of nozzle holes to discharge liquids of process colors are arranged in the sub scanning direction; and at least one auxiliary nozzle group that is provided between the first color nozzle group and the second color nozzle group, and that includes nozzle arrays each in which a plurality of nozzle holes to discharge liquids of colors different from the process colors are arranged in the sub scanning direction, wherein the first color nozzle group, the at least one auxiliary nozzle group, and the second color nozzle group are respectively shifted from each other in the main scanning direction, the at least one auxiliary nozzle group includes special color nozzle arrays to discharge liquid droplets of special color recording liquids for image formation with a difference in hue from the liquids of process colors, and nozzle arrays to discharge ink droplets of color for background formation, and a number of nozzle arrays of the special color nozzle arrays for each individual special color is less than that of the nozzle arrays to discharge ink droplets of color for background formation.

* * * * *